United States Patent [19]

Pollich

[11] Patent Number: 4,878,658

[45] Date of Patent: Nov. 7, 1989

[54] SHEET DELIVERY DEVICE IN A PRINTING MACHINE

[75] Inventor: Gerhard Pollich, Heidleberg, Fed. Rep. of Germany

[73] Assignee: Heidelberger Druckmaschinen AG, Heidelberg, Fed. Rep. of Germany

[21] Appl. No.: 786,850

[22] Filed: Oct. 11, 1985

[30] Foreign Application Priority Data

Oct. 13, 1984 [DE] Fed. Rep. of Germany ..... 3437584

[51] Int. Cl.[4] ..... B65H 29/68

[52] U.S. Cl. ..... 271/183; 271/205

[58] Field of Search ..... 271/183, 204, 205, 206

[56] References Cited

U.S. PATENT DOCUMENTS 2,381,719 8/1945 Brintnall ..... 271/183

FOREIGN PATENT DOCUMENTS 1128561 7/1982 Canada .

3007249 9/1981 Fed. Rep. of Germany .

*Primary Examiner*—Andres Kashnikow

*Assistant Examiner*—Matthew C. Graham

*Attorney, Agent, or Firm*—Herbert L. Lerner; Laurence A. Greenberg

[57] ABSTRACT

In a printing machine, a sheet delivery device having pneumatic braking devices of substantially bipartite construction on a chain delivery arranged as rotating brake rollers on a traverse extending beneath the chain delivery transversely to a sheet conveying direction through the printing machine and upstream of a sheet pile, as viewed in the sheet conveying direction, for braking and drawing-out a sheet exiting from the printing maching includes separate suction units with suction air feeding devices operatively associated with the brake rollers for feeding suction air to lateral faces of the brake rollers, at least one of the suction units being selectively associated operatively with at least one lateral face of each of the brake rollers, each of the brake rollers having a sheet-carrying peripheral surface formed with recesses distributed over the periphery of the respective brake roller and extending over a region of the width of the respective brake roller encompassing a lateral edge of the sheet-carrying peripheral surface and disposed in a radially outer region of the one lateral face of the respective brake roller, the suction units being formed with lateral air outlet openings located at a respective radially outer segment region of the one lateral face of the respective brake roller.

14 Claims, 3 Drawing Sheets

Fig. 5
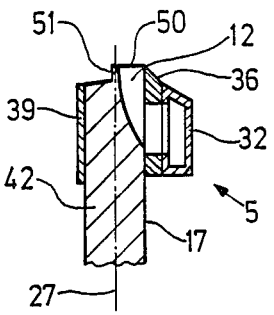
Fig. 6
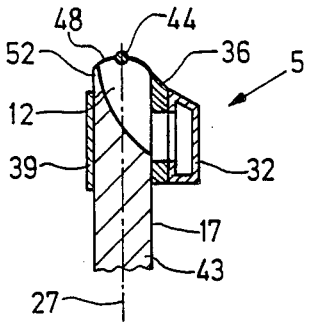
Fig. 7
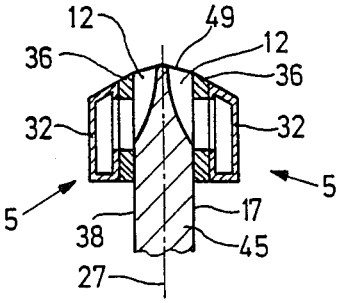
Fig. 8
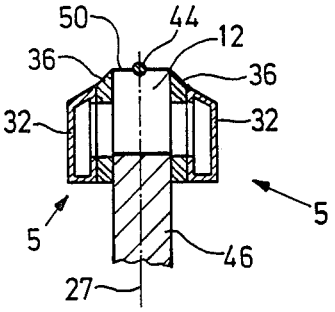
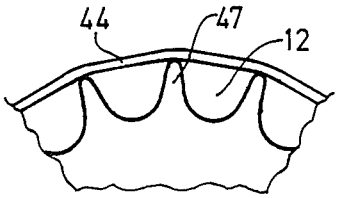
Fig. 9

SHEET DELIVERY DEVICE IN A PRINTING MACHINE

The invention relates to a sheet delivery device in a printing machine which, more particularly, has pneumatic braking devices of substantially bipartite construction on a chain delivery arranged as rotating brake rollers on a traverse extending beneath the chain delivery transversely to a sheet conveying direction through the printing machine and upstream of a sheet pile, for braking and drawing-out a sheet exiting from the printing machine.

In the case of sheet delivery devices with brake devices of this general type, the braking effect acting upon the trailing end of the exiting sheet which is to be delivered is achieved by a lower peripheral speed of the brake rollers with respect to the higher peripheral speed of the chain conveyor which corresponds to the speed of the printing machine.

Due to the difference in speed between the brake rollers and the sheet, the latter is additionally stretched or drawn out in that, while the leading edge of the sheet remains frimly held by the chain grippers, the brake rollers apply a corresponding braking effect upon the trailing end of the sheet. After being released by the chain grippers, the stretched-out sheet can drop flatly onto the delivery pile at almost the peripheral speed of the brake rollers after it has left their range of influence.

Particularly in the case of first form and perfector printing, it is necessary, due to the risk of smearing, to use the brake rollers only on the often extremely narrow print-free areas of the sheet. They are therefore generally arranged on their carrying elements in such a way as to be adjustable laterally and, in addition, if necessary, all of the brake devices, or at least the sheet carrying parts of the devices, are interchangeable with such devices having a different type of sheet carrying surface construction adn suction effect. This facility thereby permits varying the print-free zones in the print format as well as the selection of different types of paper.

Such a device is disclosed in German Published Non-Prosecuted Application (DE-OS) 28 11 963.

Apart from the considerable advantages of the sheet delivery device described in the German published application, certain disadvantages should also not be overlooked. The embodiments shown in FIGS. 4 to 8 of this German published application are evidently particularly suitable for extreme narrow print-free areas. However, difficulties arise, particularly in this regard, in that the sheets from the brake rollers are not transported to the delivery unit but, rather, remain suspended from the rollers due to the suction air being set too strong and the printing material being too thin. Exact and sensitive metering of the suction air is absolutely necessary in order to avoid this phenomenon. Difficulties also arise as a result of wearing of the brake roller rings (O-rings) which is not detected by the machine operator so that the sheets reach the fromt stops at an inclined angle.

Starting from this state of the art, it is an object of this invention to further develop a sheet delivery device in printing machines so that, especially, the advantages thereof with regard to interchangeability and flexibility, are retained while certain disadvantages are simultaneously eliminated. Thus, brake devices are to be produced which are particularly suitable for first form and perfector printing i.e. primarily with narrow, yet effective sheet carrying surfaces, as well as a wide scope of adjustment with regard to the air setting; and, finally, the influence of the wearing brake roller rings are to be reduced or their use simply rendered unnecessary.

With the foregoing and other objects in view, there is provided, in accordance with the invention, in a printing machine, a sheet delivery device having pneumatic braking devices of substantially bipartite construction on a chain delivery arranged as rotating brake rollers on a traverse extending beneath the chain delivery transversely to a sheet conveying direction through the printing machine and upstream of a sheet pile, as viewed in the sheet conveying direction, for braking and drawing-out a sheet exiting from the printing machine. The sheet delivery device comprises separate suction units with suction air feeding devices operatively associated with the brake rollers, at least one of the suction units being selectively associated operatively with at least one lateral face of each of the brake rollers, each of the brake rollers having a sheet-carrying peripheral surface formed with recesses distributed over the periphery of the respective brake roller and extending over a region of the width of the respective brake roller encompassing a lateral edge of the sheet-carrying peripheral surface and disposed in a radially outer region of the one lateral fase of the respective brake roller, the suction units being formed with lateral air outlet openings located at a respective radially outer segment region of the one lateral face of the respective brake roller.

There is also provided in accordance with the invention, in a printing machine, a sheet delivery device having pneumatic braking devices of substantially bipartite construction on a chain delivery arranged as rotating brake rollers on a traverse extending beneath the chain delivery transversely to a sheet conveying direction through the printing machine and upstream of a sheet pile, as viewed in the sheet conveying direction, for braking and drawing-out a sheet exiting from the printing machine. The sheet delivery device comprises separate suction units with suction air feeding devices operatively associated with the brake rollers for feeding suction air to lateral faces of the brake rollers, each of the brake rollers having two opposite lateral faces with each of which an air outlet opening of a respective suction unit is operatively associated for applying suction air to a radially outer segment region of the respective lateral face, each of the brake rollers having a shape somewhat like that of a chain sprocket with chain sprocket webs evenly distributed over the periphery of ther respective brake roller.

In accordance with another feature of the invention, the brake rollers are mounted on a drive shaft via respective journals serving simultaneously for supporting the respective suction units, each of the suction units being disposed through the intermediary of respective bearing clips on a carrier shaft extending parallel to the drive shaft and having a channel body provided with a suction air connection, the channel body having a front region disposed on the respective journal, the channel body being formed with a slot extending towards the lateral face of the brake roller formed with the recesses, the slot terminating in a corresponding slot formed in a segment plate which seals an upper segment region of the respective brake roller from the surroundings and serves simultaneoulsy to apply suction air over the upper segment region in its entirety.

In accordance with an additional feature of the invention, the recesses formed in the respective brake rollers are arranged on one side of a center line of the respective brake rollers.

In accordance with an added feature of the invention, the recesses formed in the respective brake rollers are arranged symmetrically with respect to a center line of the respective brake rollers.

In accordance with a further reature of the invention, the brake rollers, respectively, on the sheet carrying peripheral surface thereof, has a collar which narrows the width of the sheet carrying area and a respective one of the recesses is disposed at a raised region formed by the collar.

In accordance with again another feature of the invention, the sheet carrying peripheral surface of the respective brake rollers is curved.

In accordance with again an additional feature of the invention, the sheet-carrying peripheral surface of the respective brake rollers is bevelled symmetrically with respect to a center line of the respective brake rollers.

In accordance with still an added feature of the invention, the sheet-carrying peripheral surface of the respective brake rollers is level.

In accordance with still another feature of the invention, there is provided a suction roller ring disposed on the respective brake rollers as respective sheet-carrying elements.

In accordaance with a still further feature of the invention, the suction roller ring is seated on webs disposed between the recesses in peripheral direction of the brake rollers.

In accordance with yet an additional feature of the invention, the suction units have a respective rear part to which a leaf spring is secured via a plate and mounting screws, the leaf spring applying a counterforce or reaction force for pressing the channel body via the segment plate against the respective brake roller.

In accordance with yet an added feature of the invention, both the respective brake roller and the respective suction unit are longitudinally slidable and lockable selectively individually and jointly via a slot formed in the drive shaft and an entrainer screw cooperating therewith, as well as via a plate having a locking screw inserted in the bearing clip.

In accordance with a concomitant feature of the invention, the drive shaft is of bipartite construction and has a relatively short drive-shaft portion formed with a handle, the short drive-shaft being mounted on a side wall and being fitted by means of a shaft journal and a pin into a bore and thereby connected to a relatively long drive-shaft portion.

A device has become known heretofore from German Pat. No. 1 611 416 for transporting pieces of paper or plastic film, particularly for bag-making machines which has a feed-conveyor roller formed with rows of suction holes extending over the entire periphery thereof and connected to axial suction channels, the suction channels terminate in an end face of the feed conveyor roller and are covered thereat by a control ring which sealingly rests against the end fave and connects the suction channels with the suction line via a recess only in the vicinity of a suction sone.

If only becuase of the risk of smearing, this heretofore known device is not suitable for use in printing machines for first form and perfector printing.

Other features which are considered as characteristic for the invention are set forth in the appended claims.

Although the invention is illustrated and described herein as embodied in a sheet delivery device in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 5 is a sectional view of FIG. 4 taken along the plane of the drawing thereof and showing a different embodiment of the sheet-carrying region of the brake roller;

FIG. 6 is a view like that of FIG. 5 of another embodiment of a brake roller, with a suction roller ring in position thereon;

FIG. 7 is another view like that of FIG. 5 of a third embodiment of a brake roller, wilth recesses on both sides thereof and suction units correspondingly disposed on both sides thereof;

FIG. 8 is yet another view like that of FIG. 5 of a fourth embodiment of a brake roller, with suction units arranged on both sides thereof, the brake roller being formed in a manner similar to a chain sprocket; and FIG. 9 is a fragmentary side elevational view of FIG. 8.

Figure 1:
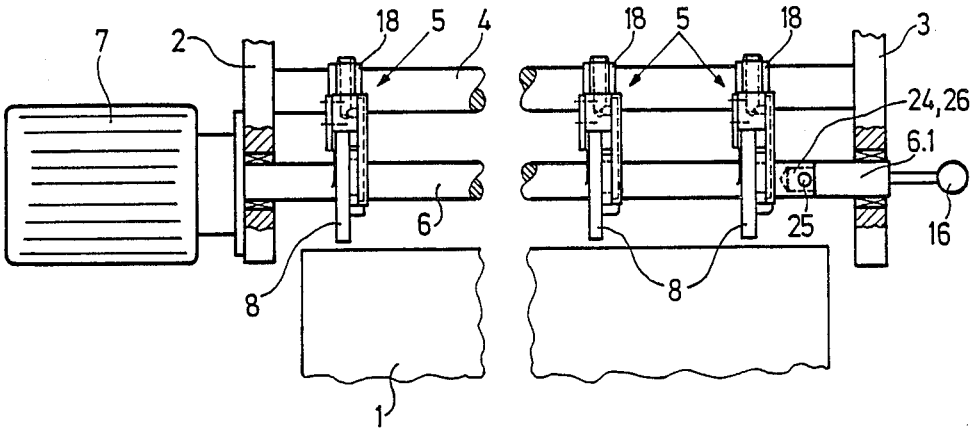
FIG. 1 is a top plan view of brake mechanisms forming part of the sheet delivery according to the invention.

Referring now to the drawing and first, particularly, to FIG. 1 thereof, there is shown, secured in side walls 2 and 3 of a sheet delivery unit in front of a delivery pile 1, a carrier shaft 4 which is used to mount suction units described in greater detail hereinafter. A number of brake rollers 8 assigned to these suction units 5 and essentially forming the brake devices in conjunction with these units are provided on a drive shaft 6 which is mounted in the side walls 2 and 3 and connected to a drive motor 7. The brake rollers 8 are driven by the drive shaft 6 at a peripheral speed which is reduced with respect to the printing machine speed, a number of brake devices being arranged at arbitrarily selected intervals on the carrier fixtures 4 and 6 thereof and brake and stress a sheet 9 to be delivered (FIG. 2) which is fed to the delivery pile 1.

Figure 2:
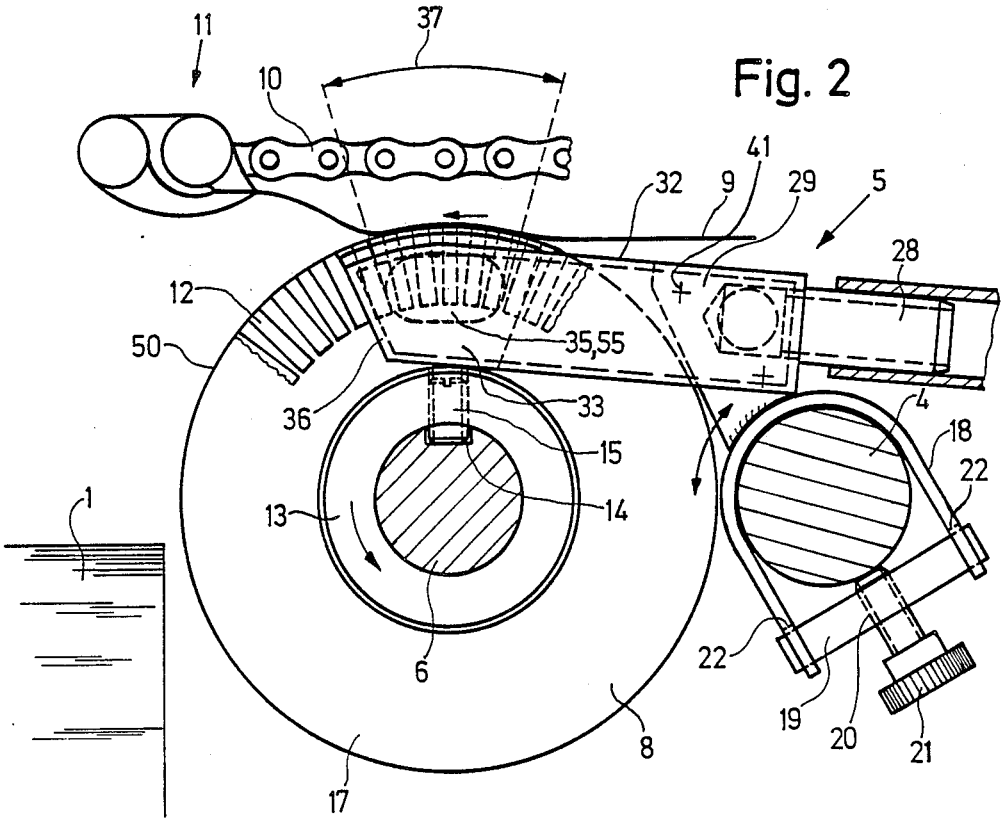
FIG. 2 is an enlarged fragmentary side elevational view of FIG. 1 showing a brake device basically of bipartite construction.

FIG. 2 shows a side view of such an inventive brake mechanism essentially of bipartite construction. Chain grippers 11 arranged at given spacings on a conveyor chain 10 convey the freshly printed sheet 9 out of the printing machine to the delivery pile 1. Shortly before reaching this delivery pile 1, the individual sheets 9 glide over the brake mechanisms, the peripheral surface of each brake roller 8 foring the sheet carrying region.

Figure 3:
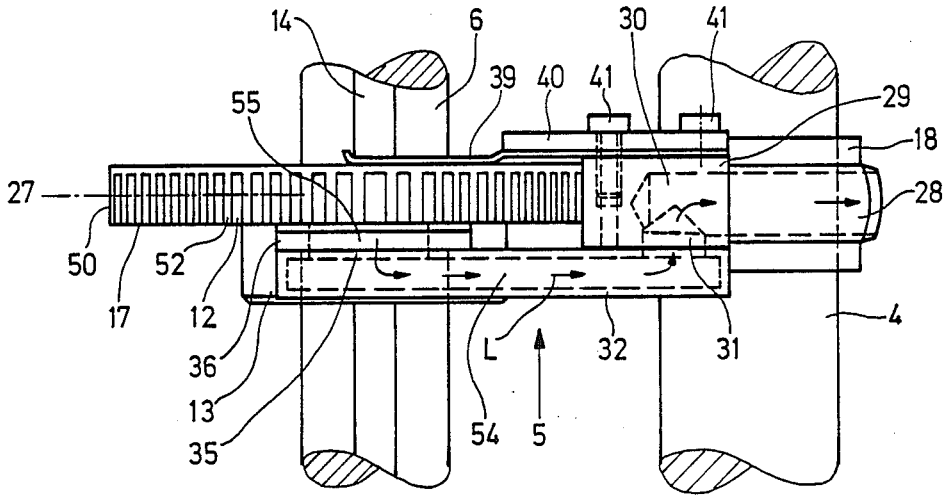
FIG. 3 is a top plan view of FIG. 2.
Figure 4:
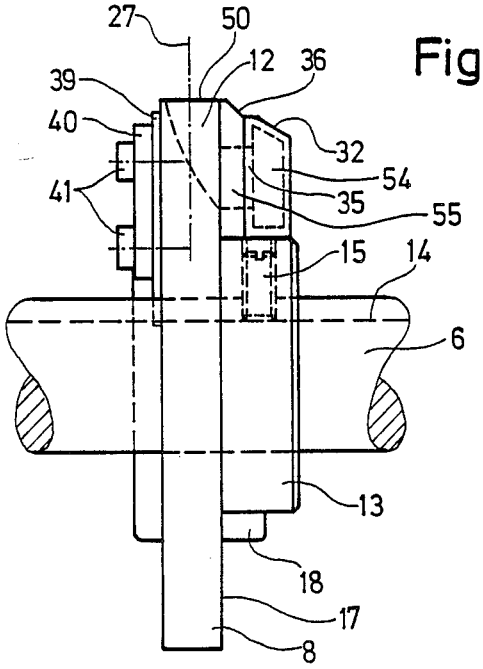
FIG. 4 is a fragmentary elevational view of FIG. 2 as seen from the left-hand side thereof.

The brake roller 8 is constructed as a disc and, in the embodiment according to FIGS. 2 to 4, is formed, on its entire smooth peripheral surface thereof with fifty lateral recesses 12 extending inwardly projecting into a face 17 thereof. On the same face 17, a bearing pin 13 is also provided which serves for mounting the brake roller 8 on the drive shaft 6 and for receiving i.e. supporting, the suction unit 5.

A positive or form-locked drive connection is produced by means of an elongated groove or slot 14 formed in the drive shaft 6 as well as an entrainer screw 15 in the bearing journal 13, which mutually cooperate. In addition, the positive drive connection is possible to shift the brake roller 8 laterally and to lock it in any position.

A suction unit 5 to which a bearing clip 18 is secured is mounted thereby on the carrier shaft 4. The bearing clip 18 has, in a lower region thereof, a plate or strap 19 having a thread 20 machined therein in which a locking screw 21 engages, so that the entire suction unit 5 can be shifted along the carrier shaft 4 and can be locked in any position in the same manner as the brake roller 8. The plate or strap 19 is inserted only loosley in two bores 22 formed in the bearing clip 18 and can be removed at any time after loosening the lock screw 21 so that the entire suction unit 5 can be raised from the carrier shaft or cross member 4.

As shown in FIG. 1, the special construction of the drive shaft 6 permits relatively simple disassembly of the brake rollers 8. For this purpose, the drive shaft 6 is split in two and a short drive shaft section 6.1 is provided which fits into a bore 26 of the drive shaft 6 through the intermediary of a shaft journal 24 and a pin 25 and is therefore connected thereto. After the pin 25 is removed, the short section 6.1 of the drive shaft is withdrawn by means of a handle 16 from its bearings in the side wall 3 so that, after the suction units 5 have been previously removed or swung away, the individual brake rollers 8 can be withdrawn one after the other through the clearance which is then formed between the drive shaft 6 and the side wall 3 and can be exchanged for other brake rollers, for example.

The suction unit 5 arranged on the carrier shaft 4 by means of the bearing clip 18 is formed of a suction air union or connection 28 which terminates in a part 29 of the suction unit 5 which is connected to the bearing clip 18 (e.g. by a weld connection), suitable bores 30 and 31 for the purpose of directing the suction air being formed in the part 29. Connected to this part 29 is an elongated channel body 32 formed with a cavity 54, a front region 33 of which rests on the bearing pin 13 of the brake roller 8. Towards the face 17 of the brake roller 8 provided wilth the recesses 12, the channel body 32 is formed with a slot 35 which terminates in a segment plate 36, which is also equipped with a corresponding slot 55, the segment plate 36, as shown particularly in FIG. 2, sealing an upper segment region 37 of the brake roller 8 at the face side from the environment and simultaneously serving to apply suction air over the entire segment region 37. A suitably differently constructed air outlet opening can, of course, also be provided instead of the slot 55.

Suction air, which travels along a path through the individual elements of the suction unit 5 is represented in FIG. 3 by means of suitable arrows, L acts upon the sheet 9, and a respective lateral suction air outlet is formed as a result of the lateral recesses 12.

the indirect contact of the channel body 32 with the brake roller 8 and the sealing effect of the intermediate segment plate 36, respectively, for example, be assisted by a leaf spring 39 which is secured to the part 29 by means of a plate 40 and mounting screws 41 and, as it were, acting as a counterforce (reaction force) presses the channel body 32 via the segment plate 36 against the brake roller 8.

This overall constructive concept permits the sheet carrying region (width) to be kept particularly narrow.

Further embodiments of the inventive brake mechanisms are shown in FIGS. 5 to 9. In the embodiment according to FIG. 5, a further reduction of the sheet carrying area is achieved by a brake roller 42 provided with a collar 51 at the outer periphery thereof. The construction of this embodiment otherwise corresponds to that of the embodiment described in detail with respect to FIGS. 2 to 4.

FIG. 6 shows a brake roller 43 with a peripherally surface 48 symmetrically curved with respect to a center line 27 thereof, the sheet 9 being carried by a suction roller ring 44 placed upon the peripheral surface 48. This is supported on webs 52 remaining between the recesses 12.

In FIG. 7, the brake roller 45 is provided with lateral recesses 12 on both sides thereof, channel bodies 32 secured to the part 29 and correspondingly constructed in accordance with the embodiment shown in FIGS. 2 to 4, as well as the segment plates 36 and the bearing pin 13 being assigned to both faces 17 and 38 of the break roller 45. The sheet carrying peripheral surface 49 of the brake roller 45 is symmetrically bevelled with respect to the center line 27, so that the sheet bearing area can, in turn, be kept very narrow. The two channel bodies 32 could also be supplied with suction are independently of one another, thereby extending metering options.

A final brief embodiment represented in FIGS. 8 and 9 also shows suction units 5 assigned to the brake roller 46 on both sides thereof. The main modification with respect to the aforementioned embodiments is in that the brake roller 46 has, as it were, a shape similar to that of a chain sprocket (FIG. 9). The sheet carrying area in this case again is formed by a suction roller ring 44 which rests on the chain sprocket webs 47 which are evenly distributed over the periphery of the brake roller 46.

In all the illustrated embodiments, the peripheral area of the respectively used brake roller can have both a flat as well as an inclined or, to a greater or lesser extent, a curved or arched shape, as well as being provided with a suction roller ring 44. If a suction roller ring 44 is not used, then, especially, the degree of curvature of inclination determines the width of the sheet carrying area.

The invention, therefore, of course, also encompasses embodiments and combinations which are not illustrated or described herein, but which can be directly derived from the disclosure of this application.

The foregoing is a description corresponding in substance to German patent application No. P 34 37 584.8, dated Oct. 13, 1984, the International priority of which is being claimed for the instant application, and which is hereby made part of this application. Any material discrepancies between the foregoing specifications and the aforementioned corresponding German application are to be resolved in favor of the latter.

I claim:

1. In a printing machine, a sheet delivery device having pneumatic braking devices of substantially bipartite construction on a chain delivery arragned as rotating brake rollers on a traverse extending beneath the chain delivery transversely to a sheet conveying direction through the printing machine and upstream of a sheet pile, as viewed in the sheet conveying direction, for braking and tightening a sheet exiting from the printing machine, comprising separate suction units with suction air feeding devices operatively associated with the brake rollers for feeding suction air to lateral faces of the brake rollers, at least one of said suction units being selectively associated operatively with at least one lateral face of each of the brake rollers, each of the brake rollers having a sheet-carrying peripheral surface formed with a multiplicity or recesses extending transversley to the sheet conveying direction and distributed adjacent one another over the periphery of the respective brake roller and extending over a region of the width of the respective brake roller, said recesses forming respective breaks in at least one lateral edge of said sheet-carrying peripheral surface and being disposed in a radially outer region of said one lateral face of the respective brake roller, said suction units being formed with lateral air outlet openings located at a respective radially outer segment region of said one lateral face of the respective brake roller.

2. Sheet delivery device according to claim 1, comprising separate suction units with suction air feeding devices operatively associated with the brake rollers for feeding suction air to lateral faces of the brake rollers, each of said brake rollers having two opposite lateral faces with each of which an air outlet opening of a respective suction unit is operatively associated for applying suction air to a radially outer segment region of the respective lateral face, each of said brake rollers having a shape somewhat like that of a chain sprocket with chain sprocket webs evenly distributed over the periphery of the respectivee brake roller.

3. Sheet delivery device according to claim 1 wherein said recesses formed in the respective brake rollers are arranged symmetrically with respect to a center line of the respective brake rollers.

4. Sheet delivery device according to calim 1, wherein said sheet-carrying peripheral surface of the respective brake rollers is curved.

5. Sheet delivery device according to claim 1, wherein said sheet-carrying peripheral surface of the respective brake rollers is bevelled symmetrically with respect to a center line of the respective brake rollers.

6. Sheet delivery device according to claim 1, wherein said sheet-carrying peripheral surface of the respective brake rollers is level.

7. Sheet delivery device according to claim 1, including a suction roller ring disposed on the respective brake rollers as respective sheet-carrying elements.

8. Sheet delilvery device according to claim 1 wherein said brake rollers are mounted on a drive shsft via respective journals serving simultaneously for supporting the respective suction units, each of said suction units being disposed through the intermediary of respective bearing clips on a carrier shaft extending parallel to said drive shaft and having a channel body provided with a suction air connection, said channel body having a front region disposed on the respective journal, said channel body being formed with a slot extending towards said lateral face of said brake roller formed with said recesses, said slot terminating in a corresponding slot formed in a segment plate which seals an upper segment region of the respective brake roller from the surroundings and serves simultaneously to apply suction air over said upper segment region in its entirety.

9. Sheet delivery device according to claim 8 wherein both the respective brake roller and the respective suction unit are longitudinally slidable and lockable selectively individually and jointly via a slot formed in said drive shaft and an entrainer screw cooperating therewith, as well as via a plate having a locking screw inserted in said bearing clip.

10. Sheet delivery device according to claim 8 wherein said drive shaft is of bipartite construction and has a relatively short drive-shaft portion formed with a handle, said short drive-shaft portion being mounted on a side wall and being fitted by means of a shaft journal and a pin into a bore and thereby connected to a relatively long drive-shaft portion.

11. Sheet delivery device according to calim 1 wherein said recesses formed in the respective brake rollers are arranged on one side of a center line of the respective brake rollers.

12. Sheet delivery device according to claim 11 wherein said brake rollers, respectively, on said sheet-carrying peripheral surface thereof, have a collar which narrows the width of the sheet-carrying area and a respective one of said recesses is disposed at a raised region formed by said collar.

13. Sheet delivery device according to claim 11, wherein said suction units have a respective rear part to which a leaf spring is secured via a plate and mounting screws, said leaf spring applying a counterforce or reaction force for pressing said channel body via said segment plate against respective brake roller.

14. In a printing machine, a sheet delivery device having pneumatic braking devices of substantially bipartite construction on a chain delivery arranged as rotating brake rollers on a traverse extending beneath the chain delivery transversely to a sheet conveying direction through the printing machine and upstream of a sheet pile, as viewed in the sheet conveying direction, for braking and tightening a sheet exiting from the printing macine, comprising separate suction units with suction air feeding devices operatively associated with the brake rollers for feeding suction air to lateral faces of the brake rollers, at least one of said suction units being selectively associated operatively with at least one lateral face of each of the brake rollers, each of the brake rollers having a sheet-carying peripheral surface formed with a multiplicity of recesses extending transversely to the sheet conveying direction and distribution adjacent one another over the periphery of the respective brake roller and extending over a region of the width of the respective brake roller, said recesses forming respective breaks in at least one lateral edge of said sheet-carrying peripheral surface and being disposed in a radially outer region of said one lateral face of the respecitve brake roller, said suction units being formed with lateral air outlet openings located at a respective radially outer segment region of said one lateral face of the respective brake roller, and a suction roller ring disposed on the respective brake rollers as respective sheet-carrying elements, said suction roller ring being seated on webs disposed between said recesses in peripheral direction of said brake rollers.

* * * * *